US006450772B1

(12) United States Patent
Oliver et al.

(10) Patent No.: US 6,450,772 B1
(45) Date of Patent: Sep. 17, 2002

(54) COMPACT MOLECULAR DRAG VACUUM PUMP

(75) Inventors: Marc Oliver, Sandy; Stephen C. Jacobsen, Salt Lake City; David F. Knutti, Taylorsville, all of UT (US)

(73) Assignee: Sarcos, LC, Salt Lake City, UT (US)

( * ) Notice: Subject to any disclaimer, the term of this patent is extended or adjusted under 35 U.S.C. 154(b) by 0 days.

(21) Appl. No.: 09/419,959

(22) Filed: Oct. 18, 1999

(51) Int. Cl.[7] ..... F04B 19/24; F04B 3/00; F01D 1/36

(52) U.S. Cl. ..... 417/53; 417/246; 417/247; 417/420; 417/423.4; 415/90; 415/143

(58) Field of Search ..... 417/53, 246, 247, 417/420, 423.4; 415/90, 143

(56) References Cited

U.S. PATENT DOCUMENTS

| | | | | | |
|---|---|---|---|---|---|
| 3,969,042 | A | * | 7/1976 | Bachler | 417/420 |
| 5,354,172 | A | * | 10/1994 | Schofield | 415/90 |
| 5,456,575 | A | * | 10/1995 | Helmer et al. | 415/90 |
| 5,482,430 | A | * | 1/1996 | Hablanian | 415/90 |
| 5,709,528 | A | * | 1/1998 | Hablanian | 415/90 |

FOREIGN PATENT DOCUMENTS

| | | | | | |
|---|---|---|---|---|---|
| JP | 57-62995 | A | * | 4/1982 | 415/90 |
| JP | 61-85599 | A | * | 5/1986 | 415/90 |

OTHER PUBLICATIONS

Levi, "Vacuum performance of molecular drag stages", *Vacuum* vol. 43 Nos. 5–7 pp. 541–543 (1992).

Panos et al., "The helicoid multi–groove vacuum pump in both viscous and molecular states", *Vacuum* vol. 45 Nos. 8 pp. 841–847 (1994).

* cited by examiner

*Primary Examiner*—Charles G. Freay
*Assistant Examiner*—Michael K. Gray
(74) *Attorney, Agent, or Firm*—Thorpe North & Western

(57) ABSTRACT

A molecular drag vacuum pump configured for pumping a gas stream from an inlet to an outlet, the pump including a high-speed spinning disk having a channel formed in its edge, disposed within a housing. A passageway is formed on the inside of the housing adjacent the disk, and gas comes in contact with surfaces of the spinning disk in successive stages, conformable wipers being disposed adjacent the spinning disk to direct the gas stream to the successive stages. The disk can be powered by an integral motor, comprising permanent magnets associated with the disk and cooperating coils associated with the housing.

20 Claims, 3 Drawing Sheets

COMPACT MOLECULAR DRAG VACUUM PUMP

BACKGROUND OF THE INVENTION

1. Field of the Invention

This invention relates to a compact, portable, molecular drag vacuum pump. More particularly, the present invention relates to a miniature drag pump having a rotor with three surfaces for contacting the gas stream in order to develop high compression ratio and very low power consumption.

2. State of the Art

In recent years, miniature, portable, and ambulatory chemical and biological sensors have been developed. These sensors have many potential applications, such as in hand-held chemical analyzers, biological detection systems, and other portable sensory instruments. Such instruments may find advantageous use by soldiers to detect the presence of chemical and biological warfare agents, or as a simple and rapid means of on-site testing of environmental contaminants or unknown substances found at a crime scene.

However, to fully realize the benefit of these new ambulatory sensor systems, new, compact, low power vacuum pumps are needed. Existing vacuum pumps capable of achieving the desired pumping characteristics are typically too large and consume too much power for compatibility with portable sensor systems. Similarly, conventional pumps that are small enough for such applications generally cannot provide the high vacuum pressure required for highly accurate sensing and testing. Such pumps are generally ineffective in the Knudsen range, where the concentration of remaining gas molecules is too small for the pump to physically move. Several solutions to this type of problem have been tried, including cryogenics, absorption of remaining gas particles, and diaphragm pumps, but without adequate success.

One type of pump that is promising for application in this area is the molecular drag vacuum pump. The concept of the molecular drag pump was first introduced by Gaede in 1913, W. Gaede, Annals of Physics, vol. 41, 337 (1913), and was later applied in a disk shaped version by Siegbahn in 1944. M. Siegbahn, Archives of Mathematics, Astronomy, and Physics, vol. B30, 2 (1944). The basic principle of operation of the molecular drag pump is to transfer momentum from a high speed moving surface, such as a disk or drum, to the associated gas, to thereby compress and direct the gas toward an outlet port. Drag between the moving surface and the gas causes the average kinetic energy of the gas molecules to increase in the pumping direction, making the remaining gas more prone to evacuate the pump chamber. In the very low pressure range, this type of pump action causes a larger number of molecules to evacuate, resulting in a more complete vacuum.

Unfortunately, traditional molecular drag pumps do not make efficient use of the space available for pumping, and generally rely on oil lubricated bearings or large, power-hungry magnetic or air bearings to achieve the desired performance. In addition, in traditional molecular drag pumps, the performance is severely limited by the tolerance between the wiper and the rotor. To solve these problems it would be desirable to have a compact molecular drag pump that allows a reduction in the fabrication tolerances of the pump parts, yet provides the desired performance. It would also be desirable to have a compact molecular drag pump that either does not require oil lubrication, or makes use of efficient compact lubricated bearings. It would also be desirable to have a compact molecular drag pump which compresses the gas in a series of stages in order to sequentially increase the pressure. Finally, it would be desirable to have a multiple stage molecular drag pump which accommodates leakage between pumping stages by directing higher pressure leakage gas into the prior stage to prime the incoming stream.

SUMMARY OF THE INVENTION

It is therefore an advantage of the present invention to provide a compact, molecular drag pump that is suitable for use with portable or hand-held sensing and testing systems.

It is another advantage of this invention to provide a compact, molecular drag pump that is more efficient than conventional drag pumps.

It is another advantage of this invention to provide a compact, molecular drag pump that obtains larger compression ratios than traditional pumps of similar size.

It is another advantage of this invention to provide a compact, molecular drag pump that allows a reduction in the fabrication tolerances of the pump parts, yet provides the desired performance.

It is another advantage of this invention to provide a compact, molecular drag pump that makes use more efficient and compact bearings for moving components.

It is yet another advantage of this invention to provide a compact, molecular drag pump that has reduced power consumption compared to traditional drag pumps.

It is still another advantage of this invention to provide a compact, molecular drag pump which provides multiple surfaces on a moving rotor for contacting the gas in a series of stages, in order to sequentially increase the pressure.

It is also an advantage of this invention to provide a multiple stage molecular drag pump which accommodates leakage between pumping stages by directing higher pressure leakage gas into the prior stage to prime the incoming stream.

The above and other advantages are realized in a compact molecular drag vacuum pump for pumping a gas stream from an inlet to an outlet, comprising a spinning cylindrical disk having a channel formed in its edge and disposed within a housing. A plurality of circular passageways, preferably three, are formed on the inside of the housing, the first passageway being disposed adjacent to the top surface of the spinning disk, the second passageway being formed within the channel formed in the outer edge of the spinning disk, and the third passageway being disposed adjacent to the bottom surface of the spinning disk. A gas stream is introduced into the first passageway through an inlet and is compressed by contact with the spinning disk in successive stages in the first passageway, the second passageway, and the third passageway, then exits through an outlet from the third passageway. Conformable plastic wiper plates are disposed at the end of the first passageway and the second passageway, respectively, to direct the gas stream to successive stages of the pump, the wiper plates being configured to conform to the shape of the spinning disk so as to substantially reduce leakage therearound.

Some of the above advantages are also realized in a compact molecular drag pump as described, further comprising an integrally formed motor comprising permanent magnets disposed in the rotor and corresponding electromagnetic coils disposed in the housing, whereby electric current provided to the coils causes the rotor to spin. Other advantages and features of the present invention will be apparent to those skilled in the art, based on the following description, taken in combination with the accompanying drawings.

DETAILED DESCRIPTION OF THE PREFERRED EMBODIMENT

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
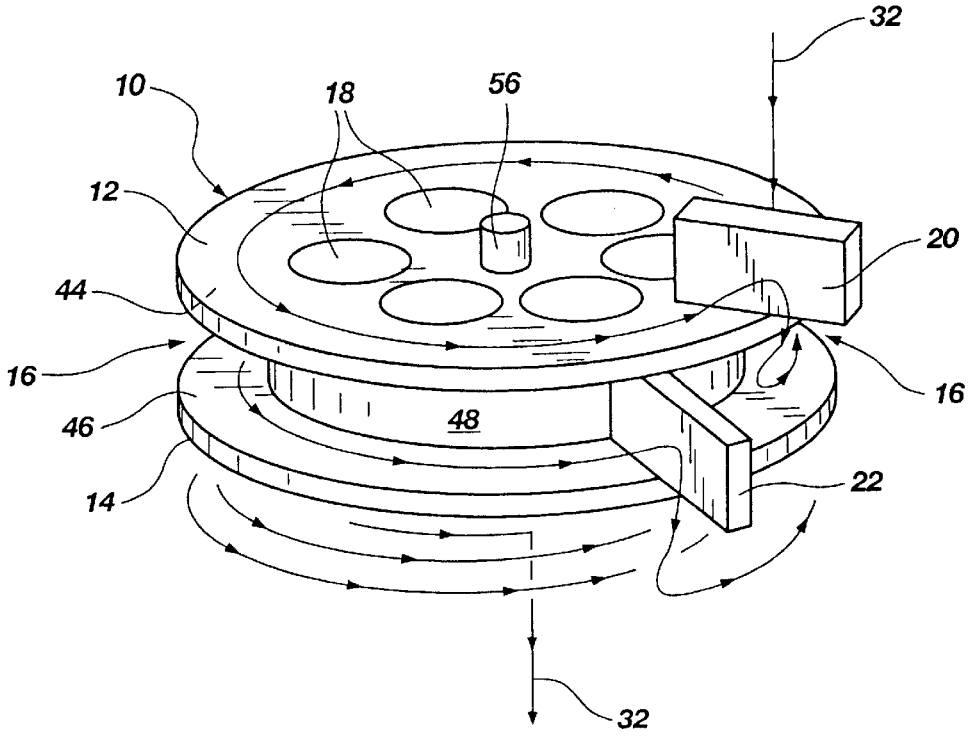
FIG. 1 provides an exaggerated pictorial view of the rotor and gas flow path associated with the molecular drag pump of this invention.

FIG. 1 provides an exaggerated pictorial view of rotor 10 and gas flow path 32 associated with the molecular drag pump of this invention. The pump of this invention comprises a rotor 10 which is configured to rotate at very high speeds of between 100,000 and 200,000 rpm, so as to approximately match the molecular speed of a gas. For clarity, rotor 10 is shown in FIG. 1 in an unassembled condition, without a housing therearound. The details of the housing structure will be given hereafter. Rotor 10 is a circular disk having a top surface 12, a bottom surface 14, and a channel 16 formed around its perimeter. Channel 16 as shown in FIG. 1 is greatly exaggerated in height and depth for purposes of clarity. Channel 16 is preferably rectangular in cross-section, having a top surface 44, a bottom surface 46, and a back surface 48. However, it will be apparent that the shape and dimensions of channel 16 may be varied for different effects. Rotor 10 may be made of any suitable rigid, lightweight material, preferably aluminum, and is preferably approximately 4 cm in diameter, and 5 mm thick, with channel 16 being approximately 5 mm wide and 3 mm deep.

A series of permanent magnets 18 are radially disposed about the center of rotor 10, on the top surface 12, or on bottom surface 14 (not visible in FIG. 1), or both. In the preferred embodiment, the magnets are only on the bottom surface. Permanent magnets 18 comprise part of the drive system of the molecular drag pump, which is described in more detail below. A vertical axle or post 56 is disposed in the center of rotor 10, and serves to support the rotor and provide a rotating bearing, as described in more detail below.

Abutting top surface 12 of rotor 10 is a first wiper plate 20 which directs the flow from a first passageway located above and adjacent to top surface 12 of the rotor, into a second passageway enclosed within channel 16, as will be described in more detail below. Disposed within channel 16 and abutting top surface 44, bottom surface 46, and back surface 48 of channel 16 is a second wiper plate 22 which directs the flow from the second passageway (in channel 16) into a third passageway located below and adjacent to bottom surface 14 of the rotor.

Figure 2:
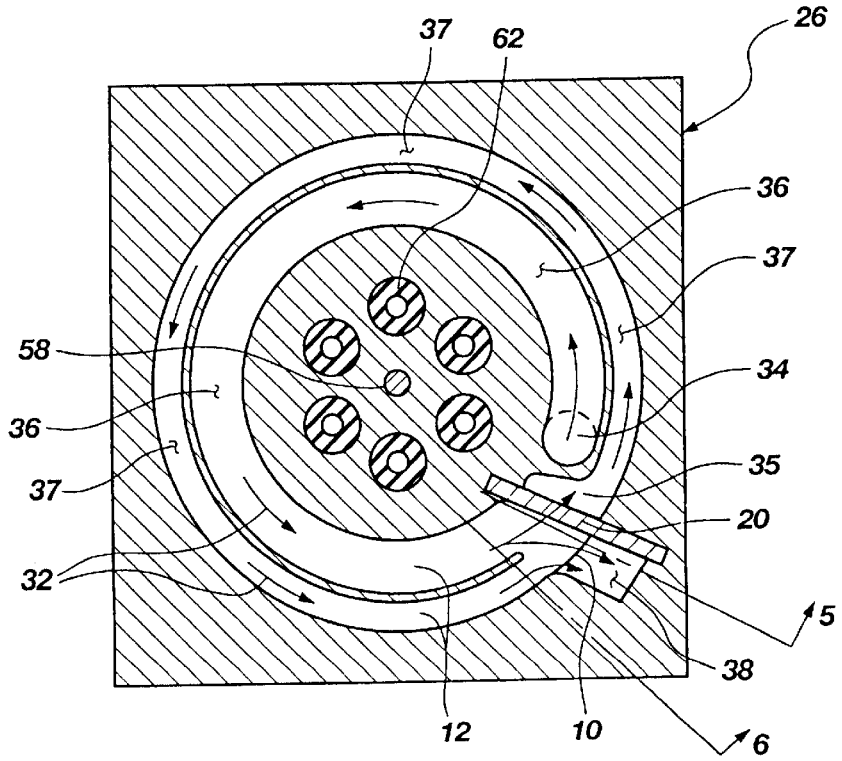
FIG. 2 shows a horizontal cross-sectional view of the inlet cover.
Figure 3:
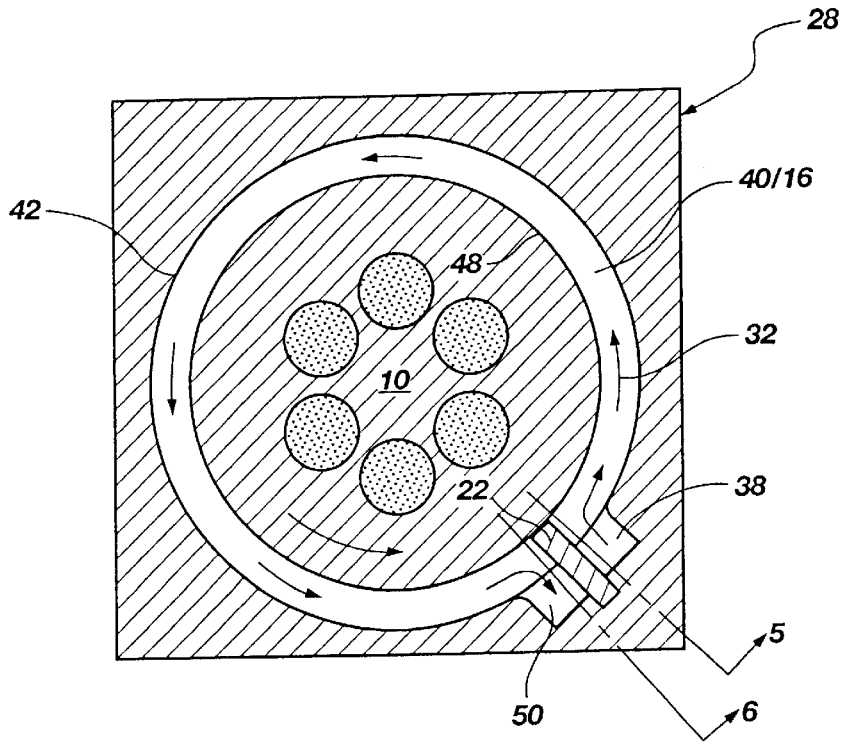
FIG. 3 shows a horizontal cross-sectional view of the stator.
Figure 4:
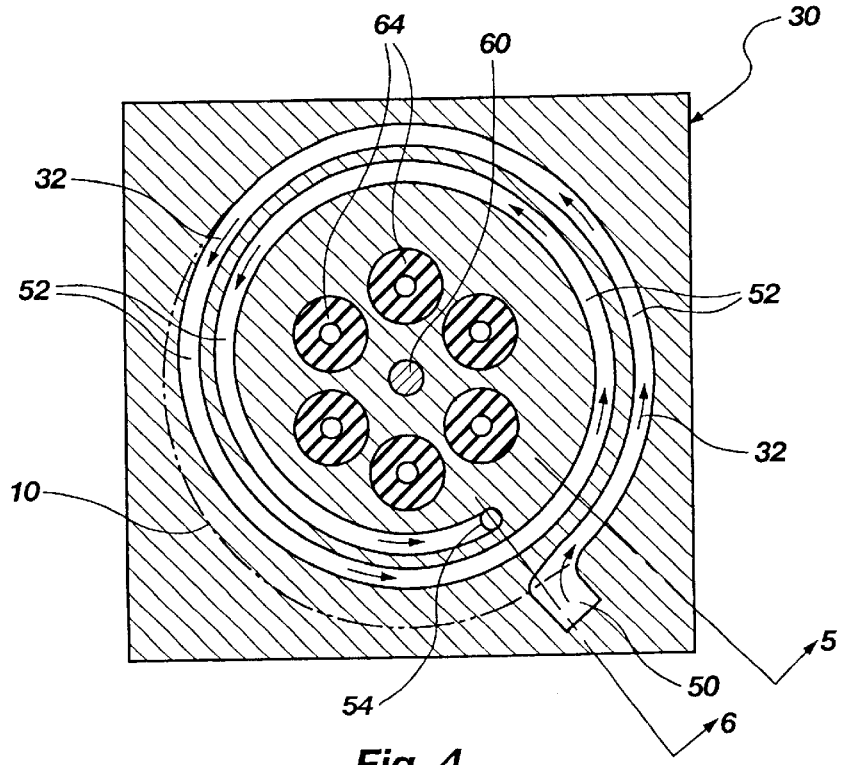
FIG. 4 shows a horizontal cross-sectional view of the outlet cover.

Rotor 10 is contained within a housing 24 (FIGS. 5 & 6) comprising an inlet cover 26, a stator 28, and an outlet cover 30. FIGS. 2, 3, and 4 provide horizontal cross-sectional views of inlet cover 26, stator 28, and outlet cover 30, respectively. In operation, gas flow, indicated by arrows 32 (FIG. 1) enters through inlet 34 (FIG. 2) into a first annular passageway 36 formed in inlet cover 26. The bottom of first passageway 36 is formed by top surface 12 of rotor 10. When rotor 10 is spinning, exchange of momentum between top surface 12 of the rotor and gas stream 32 causes the gas stream to accelerate around passageway 36 toward first wiper plate 20, increasing the average kinetic energy of gas stream 32 in the direction of rotation of rotor 10. The increase of energy in a single direction naturally increases the pressure of the gas, as described in the above references, which explain the theory and principles of operation of molecular drag pumps.

Figure 5:
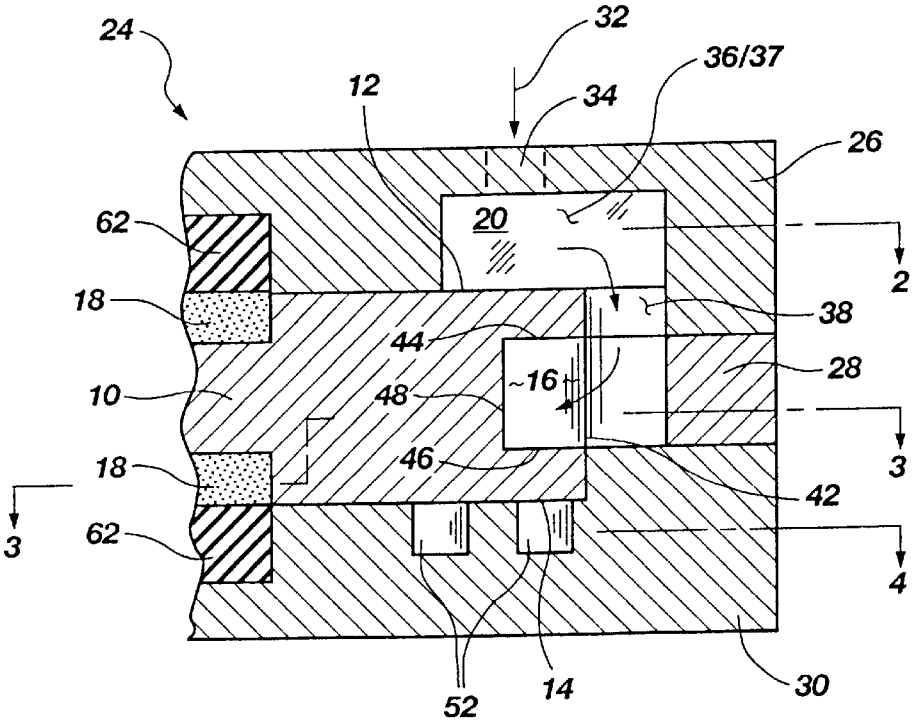
FIG. 5 is a transverse sectional view of the assembled drag pump of the present invention showing the first wiper plate, which directs the gas flow from stage one to stage two.

As stream 32 continues around first passageway 36, it approaches first wiper plate 20, which directs flow 32 radially outwardly past the edge of rotor 10, and into a first vertical tube 38, and downward to a second passageway 40. The circuit of the gas from inlet 34 to first wiper plate 20 is the first stage of compression. FIG. 5 shows a partial cross-sectional view taken near the location of first wiper plate 20, showing wiper plate 20, first passageway 36, first vertical tube 38, and second passageway 40 adjacent to rotor 10.

Naturally, there will be a small gap between the surface of the first wiper plate and top surface 12 of spinning rotor 10, which will allow some small fraction of the gas stream to leak therethrough. However, the present invention is advantageously provided with auxiliary inlet 35 and auxiliary channel 37, which capture this leakage. When leakage gas passes under wiper plate 20, it enters auxiliary inlet 35 on the opposite side thereof, and is directed into auxiliary channel 37. Auxiliary channel 37 is parallel to and outside of first passageway 36, but smaller in size. For example, in one embodiment of the invention, first passageway 36 is approximately 5 mm wide and 3 mm deep, while auxiliary channel 37 is 1 mm wide and 3 mm deep. A wall separates first passageway 36 from auxiliary channel 37, but that wall ends just before wiper plate 20, allowing the leaked gas in the auxiliary channel to be directed into first vertical tube 38 and on to the subsequent compression stages.

The provision of auxiliary channel 37 provides at least two distinct advantages. First, leakage is not lost, but is returned to stream 32 via the auxiliary channel. This allows leakage gas to be captured and compressed. Second, any gas which is not redirected by the wiper plate will nevertheless be compressed some amount more than the gas which enters inlet 34. Thus, when the stream within the auxiliary channel exits that channel and merges with the primary gas stream near the wiper plate, it will complement the total stream, creating a higher average pressure at the end of the first stage.

Second passageway 40 is located within channel 16 in the edge of rotor 10, and against inside wall 42 of stator 28 (FIG. 3). Because it is located within channel 16, second passageway 40 is bounded by only one stationary surface, inside wall 42 of stator 28, and three moving surfaces: top 44, bottom 46, and back 48 of channel 16 (FIGS. 1 & 5). By virtue of this configuration, second channel 40 imparts more kinetic energy per unit volume to gas stream 32 than other drag pump designs, which typically comprise channels formed in the housing, such that there is only one moving surface and three stationary surfaces. It will be apparent that channel 16 need not be rectangular in shape, but may be formed with more or less than three sides, with curved sides, or in any desired configuration that creates a passageway against stator wall 42 having more moving surface area than stationary surface area.

Like first passageway 36, second passageway 40 is also annular in configuration, and directs the gas stream against inside wall 42 of stator 28, around the perimeter of rotor 10 toward second wiper plate 22. The circuit of the gas from first vertical tube 38, around channel 16 to second wiper plate 22 is the second stage of compression.

Figure 6:
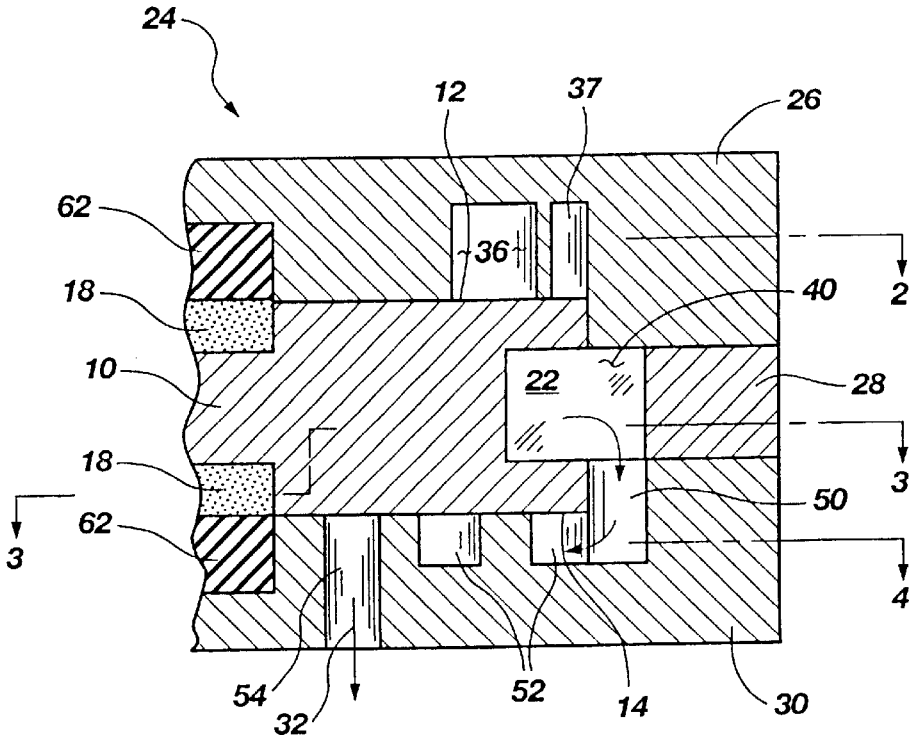
FIG. 6 is a transverse sectional view of the assembled drag pump of the present invention showing the second wiper plate, which directs the gas flow from stage two to stage three.

As with first wiper plate 20, second wiper plate 22 directs the gas stream radially outwardly past the edge of rotor 10, into a second vertical tube 50, and into third passageway 52 formed in outlet cover 30 (FIG. 4). FIG. 6 shows a cross-sectional view showing second wiper plate 22, second passageway 40, second vertical tube 50, and third passageway 52. Like first wiper plate 20, any leakage around second wiper plate 22 naturally flows back into second passageway 40, so as to "prime" the flow entering therein and further avoid loss of compressed gas in the manner described above.

Third passageway 52, similar to first passageway 36, is formed to be adjacent to bottom surface 14 of the rotor, thereby providing a third stage of compression of gas stream 32. However, unlike the first or second passageways, third passageway 52 does not merely describe one circuit of the rotor, but is preferably formed in a spiral configuration as shown in FIG. 4, and figuratively represented in FIG. 1. The spiral may describe two, three, or more inwardly spiraling circuits around the central axis of rotor 10. Each additional circuit of the circular path imparts more kinetic energy to gas stream 32, resulting in increased pressure. FIG. 4 depicts a spiral describing two circuits around the center of rotor 10, however, a spiral path describing approximately three circuits is presently preferred. Compressed gas stream 32 then exits through outlet 54.

First and second wiper plates 20 and 22 are configured as a self-sealing vane formed of a conformable plastic material such as Ultem plastic, manufactured by A.L. Hyde Company, Inc. (1 Main St., Greenloch, N.J. 08032). As rotor 10 rotates in its early operation, the plastic material of the wiper plates naturally abrades and conforms to match the exact size and shape of the opening it is to fill. Once deformed as required, the wiper will form a tight seal against the rotor, while creating very little friction. So long as the wiper plate adequately fills the space against the rotor and within the respective passageway, it will redirect the flow of gas as needed with very little leakage. However, as noted, the present invention advantageously directs any leakage which may occur around the wiper plates, back into the respective passageways, thereby imparting its kinetic energy to the incoming stream to "prime" the incoming gas flow.

By virtue of its three-stage design, the present molecular drag pump imparts more kinetic energy to the gas stream for a given rotational speed than conventional disk type molecular drag pumps, and is thus able to obtain higher compression of the gas stream with less energy. Compression is also enhanced by the slotted rotor design, which provides more surface area of contact between the rotor and the gas stream. Though shown with only one channel 16, it will be apparent that rotor 10 could be provided with more than one channel to provide additional compression stages. Additionally, a drag pump could be configured with more than one rotor, possibly rotating at different speeds, to provide for more stages of compression as an other obvious modification.

Several other advantageous design features also contribute to the effective functioning of this invention. As shown in FIG. 1, rotor 10 includes a bearing hub 56 disposed in its center. Rather than providing oil lubricated bearings or expensive air bearings which require very precise fabrication tolerances and which are also very difficult to physically isolate from the vacuum chamber and pumping channels, the rotor of this pump is fixed upon a simple cylindrical axle 56 which fits into corresponding cylindrical holes 58 and 60 formed in the center of inlet cover 26 and outlet cover 30, respectively. To provide for the rapid rotation of the axle within the holes, the axle utilizes a low friction, low wear solid lubricated carbon coating. A suitable carbon coating of this type is a diamond-like low wear carbon coating manufactured by Argonne National Laboratory (9700 South Cass Avenue, Argonne, Ill., 60439). This solid lubricated coating allows a very simple rotating bearing to provide reliable support for the rotor at the high speeds required, with very little wear.

Also of great value to the present invention is the motor design. It will be apparent to one skilled in the art that many drive motor configurations could be provided to impart the necessary rotation to rotor 10. For example, a high speed electrical motor could be connected to bearing hub 56 to cause the rotor to spin. However, the compact molecular drag pump disclosed herein preferably comprises an integrally formed electrical motor for driving the rotor. As noted above, disposed around the center of top surface 12 and bottom surface 14 of rotor 10 are a circle of permanent magnets 18. These magnets are arranged to lie opposite a circle of electric coils 62 and 64, disposed about the center of the inside of inlet cover 26, and outlet cover 30, respectively. Electric current provided to coils 62 and 64 interacts with permanent magnets 18, causing rotor 10 to turn in the same manner as the rotor of a brushless permanent magnet motor. The inventors have found that the pump and motor configured in this manner are capable of pumping 500 cc/min, with a compression ratio of 1000, while consuming only 5 watts of power. Though two sets of magnets 18 and coils 62 and 64 are shown and/or described, it will be apparent that the pump could be provided with a single set of magnets and coils and still meet the requirements of this invention.

With this unique combination of a multiple stage drag pump, low friction bearings, and integral motor design, the inventors are thus able to produce a reliable, low cost, high efficiency molecular drag pump that is superior to prior art drag pumps in its power and efficiency, and is suitable for a wide range of applications. It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A molecular drag vacuum pump configured for pumping a gas stream from an inlet to an outlet, the pump comprising:

a) a spinning disk having a channel formed in a disk edge;

b) a wiper adjacent to all surfaces of the channel, whereby the gas stream introduced into the inlet is compressed through contact with a surface of the spinning disk while traveling at least through a portion of the channel toward the outlet;

c) at least one circumferential passageway disposed adjacent the spinning disk and in fluid communication with the inlet and outlet, for directing the gas stream into at least a portion of the channel, and further comprising a first passageway in fluid communication at a first end with the inlet, a second passageway in fluid communication at a first end with a second end of the first passageway, and a third passageway in fluid communication at a first end with a second end of the second passageway, and at a second end with the outlet;

d) a housing enclosing the spinning disk, the housing comprising an inlet cover having an inside and an outside, a stator having an inside surface, and an outlet cover having an inside and an outside;

e) an inlet comprising a conduit formed in the inlet cover and extending from the outside to a first end of the first passageway;

f) wherein the outlet comprises a conduit formed in the outlet cover and extending from the second end of the third passageway to the outside of the outlet cover;

g) wherein the first passageway comprises at least one circular channel formed on the inside of the inlet cover so as to be disposed adjacent to the top surface of the spinning disk;

h) the second passageway comprises a circular channel defined by the channel formed in the edge of the spinning disk and the inside surface of the stator; and i) the third passageway comprises a circular channel formed on the inside of the outlet cover so as to be disposed adjacent to the bottom surface of the spinning disk.

2. The molecular drag vacuum pump as described in claim 1, wherein the first passageway comprises:

a) a first primary passageway in fluid communication with the inlet; and b) a first auxiliary passageway in fluid communication at a second end with the second end of the first primary passageway, the first auxiliary passageway formed substantially parallel to the first primary passageway and disposed radially outwardly therefrom.

3. The molecular drag vacuum pump as described in claim 2, wherein leakage around the first wiper plate is directed into a first end of the first auxiliary passageway, and rejoins the gas stream at the second end of the first primary passageway.

4. The molecular drag vacuum pump as described in claim 1, wherein the third passageway comprises a spiral channel.

5. The molecular drag vacuum pump as described in claim 4, wherein the spiral channel describes at least two revolutions about the center of the spinning disk.

6. A molecular drag vacuum pump for pumping a gas stream from an inlet to an outlet, the pump comprising:

a) a spinning disk having a channel formed in a disk edge;

b) a wiper plate adjacent to all surfaces of the channel, whereby the gas stream introduced into the inlet is compressed through contact with a surface of the spinning disk while traveling at least through a portion of the channel toward the outlet;

c) at least one circumferential passageway disposed adjacent the spinning disk and in fluid communication with the inlet and outlet, for directing the gas stream into at least a portion of the channel, and further comprising a first passageway in fluid communication at a first end with the inlet, a second passageway in fluid communication at a first end with a second end of the first passageway, and a third passageway in fluid communication at a first end with a second end of the second passageway, and at a second end with the outlet;

d) a top surface on the spinning disk;

e) a first wiper plate disposed within the second end of the first passageway and adjacent to the top surface of the spinning disk to direct the gas stream from the first passageway to the second passageway;

f) a second wiper plate disposed within the second end of the second passageway and adjacent to all sides of the channel, to direct the gas stream from the second passageway to the third passageway; and g) wherein leakage around the first wiper plate is directed back into the first passageway, and leakage around the second wiper plate is directed back into the second passageway.

7. A method of pumping a gas, comprising the steps of:

a) causing a disk having a channel formed in a disk edge to spin about its axis;

b) introducing a gas stream into a series of three generally circumferential passageways adjacent to the channel and other moving surfaces of the disk such that the spinning disk will impart kinetic energy to the gas stream to compress the gas stream in three successive stages, the first passageway being disposed adjacent a top surface of the spinning disk, the second passageway being within the channel, and the third passageway being disposed adjacent a bottom surface of the spinning disk;

c) directing the gas from the first passageway to the second passageway by means of a first self-sealing wiper plate formed of a ductile plastic material conformable to the shape of the surface of the spinning disk; and d) directing the gas from the second passageway to the third passageway by means of a second self-sealing wiper plate formed of a ductile plastic material conformable to the shape of the channel formed in the edge of the spinning disk;

e) directing gas which leaks around the first self-sealing wiper plate into a first end of a first auxiliary passageway disposed adjacent to the top surface of the spinning disk, the first auxiliary passageway being in fluid communication at a second end with a second end of the first passageway, whereby leakage gas may be further compressed and directed back into the gas stream; and f) allowing the compressed gas stream to exit the passageways.

8. A method of pumping a gas, comprising the steps of:

a) causing a disk having a channel formed in a disk edge to spin about its axis;

b) introducing a gas stream into a series of three generally circumferential passageways adjacent to moving surfaces of the disk, such that the spinning disk will impart kinetic energy to the gas stream to compress the gas stream in three successive stages, the first passageway being disposed adjacent a top surface of the spinning disk, the second passageway being within the channel, and the third passageway being disposed adjacent a bottom surface of the spinning disk;

c) directing the gas from the first passageway to the second passageway by means of a first self-sealing wiper plate formed of a ductile plastic material conformable to the shape of the surface of the spinning disk;

d) directing the gas from the second passageway to the third passageway by means of a second self-sealing wiper plate formed of a ductile plastic material conformable to the shape of the channel formed in the edge of the spinning disk;

e) allowing the compressed gas stream to exit the passageways; and f) wherein the step of directing the gas into the third passageway comprises directing the gas in a spiral path adjacent the bottom surface of the spinning disk before allowing the compressed gas stream to exit, the spiral path describing at least two revolutions about the center of the spinning disk.

9. A molecular drag vacuum pump, comprising:

a housing defining an inlet and an outlet and configured to facilitate flow of a gas from the inlet to the outlet;

a rotor rotatably carried within the housing, the rotor including a first side, an edge side, and, a second side opposite the first side, and having an axis of rotation;

a first passageway in fluid communication with the inlet, said first passageway being disposed intermediate the housing and the first side, being defined by the housing and the first side, a second passageway in fluid communication with the first passageway, said second passageway disposed intermediate the housing and the edge side, being defined by the housing and the edge side, a third passageway in fluid communication with the second passageway and the outlet, said third passageway disposed intermediate the housing and the second side, being defined by the housing and the second side, a first wiper carried by the housing, configured so as to redirect flow of gas from the first passageway to the second passageway;

a second wiper carried by the housing and configured so as to redirect flow of gas from the second passageway to the third passageway;

the gas being urged to enter the inlet and to rotate around the rotor axis at least one complete revolution before exiting the outlet.

10. A molecular drag vacuum pump as in claim 9, wherein gas being pumped makes substantially one revolution about the rotor axis in each passageway.

11. A molecular drag vacuum pump as in claim 9, wherein the wipers comprise a different material than the housing.

12. A molecular drag vacuum pump as in claim 11, wherein the wipers are configured to provide minimum clearance between the wipers and the rotor.

13. A molecular drag vacuum pump as in claim 9, wherein the rotor further comprises at least one electric motor rotor element and the housing comprises at least one stator of said electric motor.

14. A molecular drag vacuum pump as in claim 9, wherein the rotor further comprises a magnet, and the housing further comprises a coil configured to cooperate with the magnet to provide a force which acts on the rotor to turn it within the housing.

15. A molecular drag vacuum pump as in claim 14, wherein the rotor comprises at least two magnets configured to have opposite polarity with respect to a direction parallel to an axis of rotation of the rotor.

16. A molecular drag vacuum pump as in claim 12, wherein the wipers is formed of a material less rigid than the material of the rotor.

17. A molecular drag vacuum pump as in claim 16, wherein the wiper comprises a conformable polymeric material.

18. A molecular drag vacuum pump as in claim 17, wherein the wiper is abraded by the rotor so as to form a low-friction seal.

19. A molecular drag vacuum pump as in claim 9, wherein one of the first and third passageways is configured to define a spiral.

20. A molecular drag vacuum pump as in claim 9, wherein the pump is driven by a motor incorporated in the rotor and the housing, said motor comprising a coil incorporated in at least one of the housing and the rotor.

* * * * *

UNITED STATES PATENT AND TRADEMARK OFFICE

CERTIFICATE OF CORRECTION

PATENT NO. : 6,450,772 B1 
DATED : September 17, 2002
INVENTOR(S) : Olivier, Marc; Jacobsen, Stephen C. and Knutti, David F.

It is certified that error appears in the above-identified patent and that said Letters Patent is hereby corrected as shown below:

Title page,
Item [75], Inventors, replace "Oliver" with -- Olivier --.

Signed and Sealed this

Second Day of March, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,450,772 B1
APPLICATION NO. : 09/419959
DATED : September 17, 2002
INVENTOR(S) : Marc Olivier, Stephen C. Jacobsen and David F. Knutti It is certified that error appears in the above-identified patent and that said Letters Patent is hereby corrected as shown below:

Column 1, line 3, insert the following Government Interest statement:

--Statement of Government Rights
This invention was made with government support under DABT63-97-C-0066 awarded by DARPA Department of Defense Advanced Research Projects Agency. The government has certain rights in the invention.--

Signed and Sealed this
Seventeenth Day of April, 2012

David J. Kappos

David J. Kappos
*Director of the United States Patent and Trademark Office*